United States Patent [19]

Strahs et al.

[11] Patent Number: 4,524,938

[45] Date of Patent: Jun. 25, 1985

[54] SELF CONTAINED BROOM HANGING SYSTEM

[75] Inventors: Martin P. Strahs, Lawrenceville; John Vosbikian, Mt. Laurel, both of N.J.

[73] Assignee: Quickie Manufacturing Corporation, Cinnaminson, N.J.

[21] Appl. No.: 458,307

[22] Filed: Jan. 17, 1983

[51] Int. Cl.[3] ..... A46B 17/02

[52] U.S. Cl. ..... 248/110; 248/224.1

[58] Field of Search ..... 248/110, 111, 314, 544, 248/224.1, 467, 224.4, 225.1, 359, 360; 211/65, 66

[56] References Cited

U.S. PATENT DOCUMENTS

| | | | |
|---|---|---|---|
| 323,827 | 8/1885 | Pritchett | 248/111 |
| 606,208 | 6/1898 | Gutmann | 248/224.1 X |
| 835,725 | 11/1906 | Bollman | 248/111 |
| 3,389,883 | 6/1968 | Johnson | 248/224.1 |
| 3,553,888 | 1/1971 | Daly et al. | 248/224.1 X |
| 3,964,708 | 6/1976 | Reeves | 248/314 X |
| 4,132,380 | 1/1979 | Pastore | 248/224.1 |
| 4,220,309 | 9/1980 | Eisen | 248/544 X |
| 4,228,982 | 10/1980 | Sellera | 248/467 |
| 4,340,199 | 7/1982 | Brock | 248/544 |

*Primary Examiner*—J. Franklin Foss

*Attorney, Agent, or Firm*—Steele, Gould & Fried

[57] ABSTRACT

A self contained broom hanging system is disclosed which includes a broom having a hollow hanger housing formed in the broom shroud. A separable hanger is removeably retained within the hanger housing for storage within the housing in a releasable manner during shipping and storage and prior to vending. After sale, the hanger is removed from association within the hanger housing and is affixed to a wall surface in a desired location. The hanger includes an integral projection of size and position to engage a V-shaped notched portion of the hanger housing for convenient broom hanging purposes.

18 Claims, 5 Drawing Figures

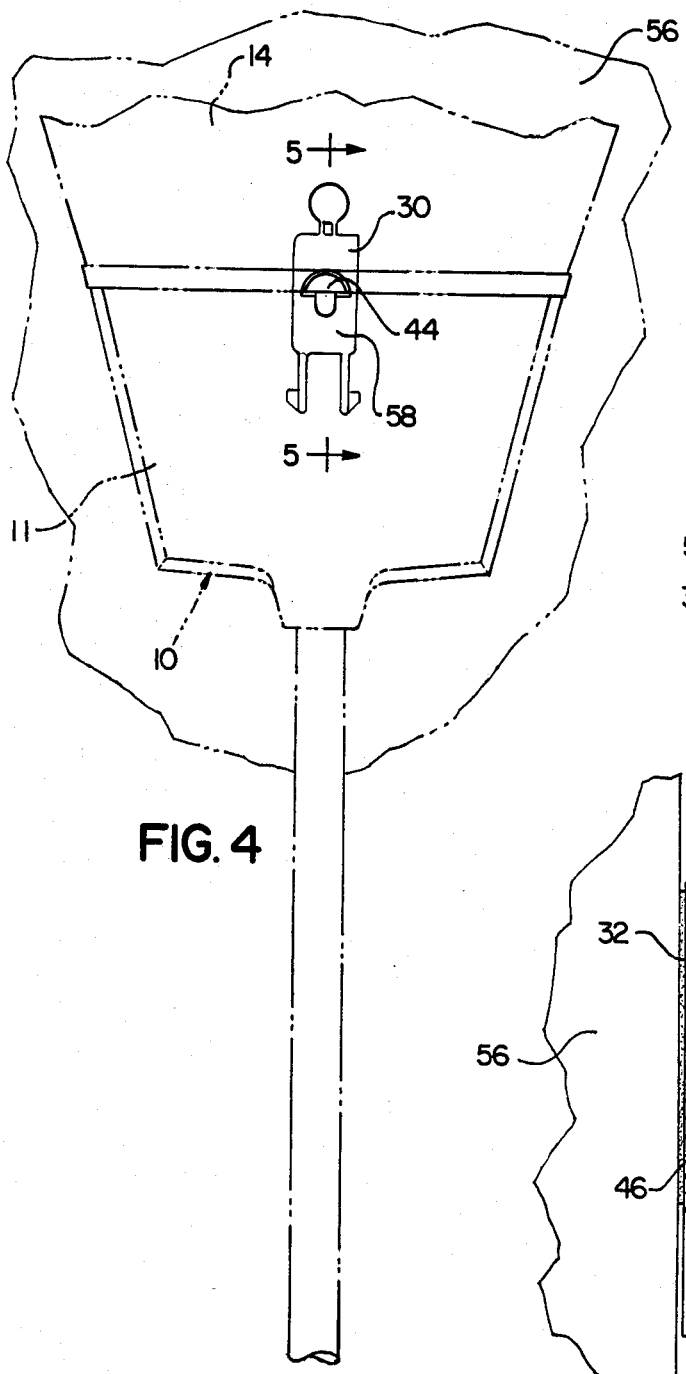
FIG. 4
FIG. 3
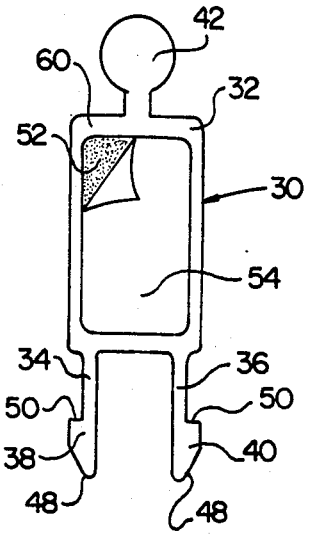
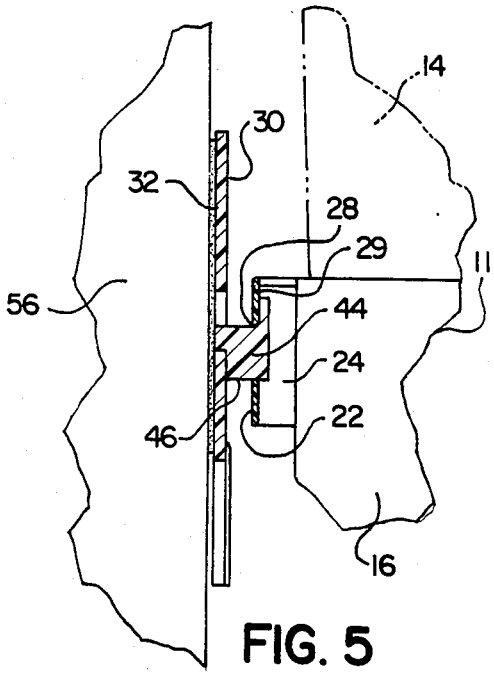
FIG. 5

SELF CONTAINED BROOM HANGING SYSTEM

FIELD OF INVENTION

The present invention relates generally to the field of cleaning devices, and more particularly, is directed to a novel broom including a broom hanging system.

BACKGROUND OF THE INVENTION

Cleaning devices with elongated handles, such as brooms, have long been utilized for floor and walk sweeping purposes both in this country and many foreign countries. The prior art brooms as currently in use usually consist of an elongated wooden or plastic handle to which a sweeping device is affixed at one end. The most common brooms have long been fabricated of broom corn and in the past have usually been hand crafted for the intended use. More recently, brooms have also been fabricated of various plastic strands in addition to the more conventional broom corn. Also, modern manufacturing techniques have made it possible to utilize automated equipment in forming the brooms thereby providing for a more uniform product at decreased costs, inasmuch as fewer manual operations and consequently fewer workers were required during the broom fabrication process.

In view of their elongate construction and rather ungainly configuration, the proper storage of brooms when not is use has always presented certain problems for the homeowner. Consequently, numerous types of metallic and plastic broom hangers for hanging the brooms in an orderly manner have been developed by prior workers in the art. Many configurations of hangers varying in complexity from a simple nail hanger to fairly complicated spring type hangers have previously been utilized. However, so far as is known to the applicants, all of the prior art broom hanging devices were separate from the broom and presented certain complications in securing the hangers within the storage area, The hangers usually required special tools such as a hammer or a screwdriver in order to properly accomplish the hanger installation task. None of the prior art broom and hanger constructions, so as far is known, provided a complete system wherein the broom and the hanger were vended as a unit and wherein the hanger itself could be applied to any smooth vertical surface without the need for any additional tools.

SUMMARY OF THE INVENTION

The present invention relates generally to the field of brooms and hangers, and more particularly, is directed to a broom construction incorporating a self contained broom hanging system.

The broom and hanging system of the present invention includes in combination a sweeping device, such as a broom construction of a relatively conventional configuration having an elongate wooden or metal handle. The sweeping portion or broom may be fabricated either of broom corn or suitable plastic fiber and is affixed to one end of the handle in any known conventional manner. As used herein, the designation "fibers" is defined to mean all slender, flexible, elongate materials suitable for sweeping purposes and includes both natural and synthetic materials. An enclosing molded or otherwise formed plastic keeper or shroud overfits the upper portion of the fibers and the bottom of the handle to provide a decorative and sturdy broom construction, also in well known manner.

Integrally formed in the shroud by injection molding or other suitable plastic forming operation is a hanger holder of construction strong enough to support the broom construction when the broom is hung. The hanger holder or housing comprises an integral outer wall within which is formed a V-shaped notch for broom hanging purposes. The hanger housing defines a hollow interior space for receipt therein of a separate flat plastic hanger while the broom is being initially shipped and vended.

The separate hanger incorporates a relatively planar body and a pair of generally parallel legs extending from the body. The legs terminate in oppositely outwardly extending feet, the outer extent of which are spaced apart a distance greater than the width of the hanger holder. By pressing the feet toward each other, the total distance therebetween can be intially decreased sufficiently to insert the legs upwardly through the bottom of the hanger holder until the feet upwardly engage the top of the hanger housing. Once the feet are clear of the hanger housing, the legs will be released whereby the natural spring bias of the plastic material will return the feet to their original, unstressed positions, thereby removably engaging the hanger within the hanger housing. To remove the hanger from the hanger housing, all that is required is to grasp the feet with the fingers of one hand and then press them together sufficiently to allow the feet to slide downwardly within the hanger housing until the hanger is clear and entirely separate from the hanger housing.

The hanger itself is formed of suitable plastic by injection molding or otherwise and includes an integral projection or hook, which hook is medially positioned upon the hanger body and which faces normally in a direction opposite the direction of extension of the legs. The back of the hanger is formed in a planar configuration and is provided with a suitable adhesive surface and peel strip of known construction and composition. Accordingly, once the hanger is removed from association within the hanger housing, all that is required to utilize the hanger is to turn the hanger through one hundred and eighty degrees, remove the peel strip to expose the adhesive surface and then press the adhesive surface against any vertical surface, for example, the interior wall of a closet wherein it is desired to store the broom when it is not in use.

In order to assure that the housewife or other user of the broom can readily determine the proper orientation of the hanger, preferably a decorative indicator extends from the hanger body in a direction opposite from the direction of the legs. The indicator may be decorated with a face or other indicia to readily indicate which end of the hanger is to be positioned upwardly.

It is therefore an object of the present invention to provide a novel broom with self contained broom hanging system of the type set forth.

It is another object of the present invention to provide a novel broom with self contained broom hanging system which includes in combination a broom including an enclosing plastic shroud or keeper, a hollow hanger housing integrally formed in the keeper and a separable plastic hanger which can be removably retained within the hanger housing until the hanger is to be utilized for broom hanging purposes.

It is another object of the present invention to provide a novel broom with self contained broom hanging system which includes hanger housing means integrally formed with a broom shroud, hanger means removably retained within the hanger housing means, and cooperating projection and recess means respectively formed in the hanger means and in the hanger housing means to permit the broom to be readily supported by the hanger means when the hanger means is detached from the hanger housing means and is affixed to a wall.

It is another object of the present invention to provide a novel broom with self contained broom hanging system that is inexpensive in manufacture, simple in design and trouble free when in use.

Other objects and a fuller understanding of the invention will be had by referring to the following description and claims of a preferred embodiment thereof, taken in conjunction with the accompanying drawings, wherein like reference characters refer to similar parts throughout the several views in which:

BRIEF DESCRIPTION OF THE DRAWINGS

FIG. 3 is an enlarged, elevational view showing the reverse side of the hanger.

FIG. 4 is a partial, front elevational view showing the hanger in hanging position and the broom in phantom lines to illustrate the broom and the hanger in the hanging relationship.

FIG. 5 is an enlarged cross-sectional view taken along line 5—5 on FIG. 4, looking in the direction of the arrows.

DESCRIPTION OF THE PREFERRED EMBODIMENT OF THE INVENTION

Figure 1:
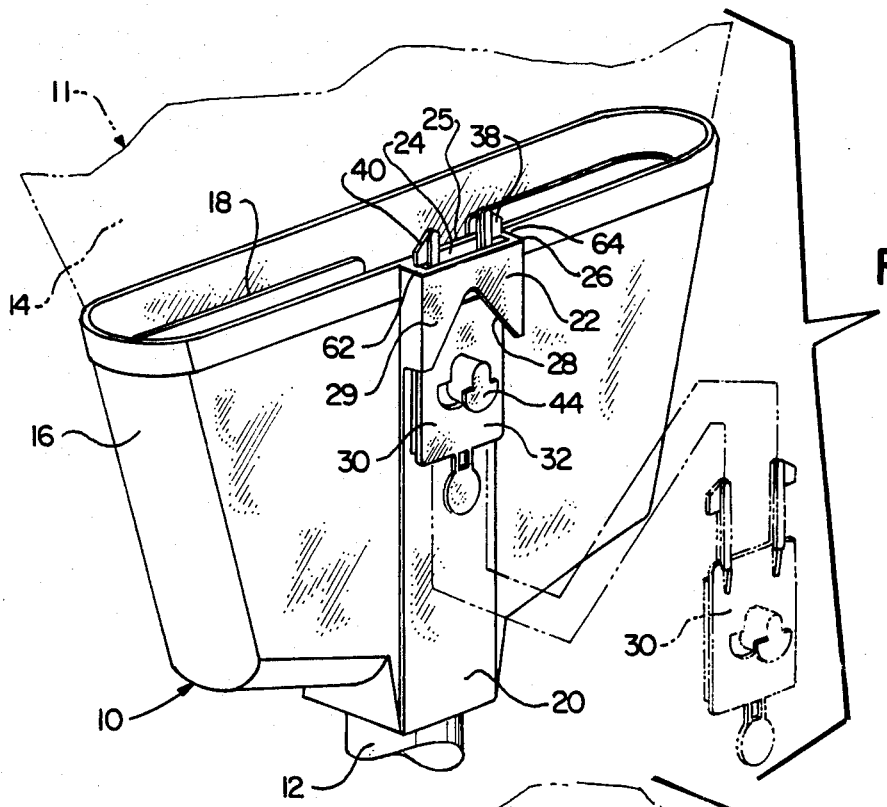
FIG. 1 is a partial, perspective view showing in full lines the hanger positioned within the hanger housing and showing in phantom lines the hanger removed from association from within the hanger housing.

Although specific terms are used in the following description for the sake of clarity, these terms are intended to refer only to the particular structure of the invention selected for illustration in the drawings, and are not intended to define or limit the scope of the invention.

Figure 2:
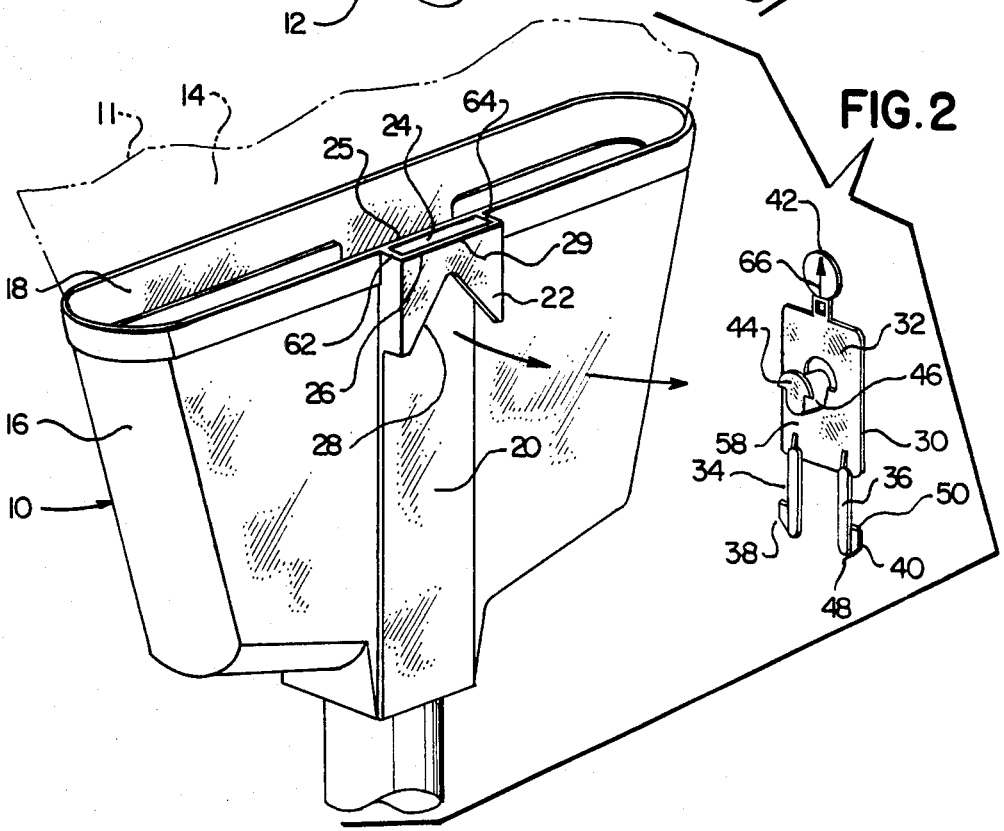
FIG. 2 is a perspective view similar to FIG. 1 showing the hanger removed from the hanger housing and rotated through one hundred and eighty degrees prior to being affixed to a wall for broom hanging purposes.

Referring now to the drawings, as best seen particularly in FIGS. 1 and 2, there is illustrated a broom construction with self contained hanging system 10 which includes in combination a broom 11 which may be of conventional design and which is intended to be vended in combination with a readily disengageable flat plastic hanger 30. The broom 11 conventionally comprises an enlongate handle 12 of wooden or metallic construction to which conventional broom corn 14 or other elongated fibers can be affixed at one end in conventional matter for usual sweeping purposes.

A thin, sturdy shroud or keeper 16 is molded or otherwise conventionally formed to provide a hollow interior 18 of suitable configuration and design to overfit the interconnection between the top of the broom corn 14 and the bottom of the broom handle 12 to provide a secure and decorative construction. The shroud 16 is formed to provide an integral molded ridge 20 which may extend in height the entire height of the keeper 16 for strengthening and decorative purposes.

The molded, vertical ridge 20 terminates near its top edge in an integral hanger holder 22, which holder is fabricated in known manner to define a hollow hanger storage space 24. The hanger holder 22 terminates in a planar top 26 for hanger retaining purposes in the manner hereinafter more fully set forth. A V-shaped notch 28 is formed in the outer wall 24 of the hanger holder 22 for broom hanging purposes as more completely described below. It is noteworthy that the V-shaped notch 28 is spaced away from the shroud wall 25 by a distance equal the depth or thickness of the hanger holder 22 in a manner to provide sufficient clearance for receiving the hook portion 44 of the hanger 30 when the broom 11 is stored and supported upon the hanger 30.

Still referring to FIGS. 1 and 2 and further considering FIG. 3, an easily separable hanger 30 is provided in conjunction with the hanger holder 22. The hanger 30 is preferably fabricated of injection molded plastic and is designed to be engageable within the hanger holder 22 for storage within the hollow interior 24 when the broom 11 is initially shipped from the factory and while it is still being vended at the store. When the broom reaches its final destination within a home or other establishment, the hanger 30 is intended to be easily removed from association within the hanger holder 22, whereby it may easily be applied to a wall surface 56 (FIG. 5) for broom hanging purposes in the manner hereinafter more fully described.

In order to facilitate insertion and removal of the hanger 30 into and from the hanger holder 22, the hanger is formed with a generally planar body 32 which preferably may be of generally rectangular configuration to provide adequate surface for adhesion to the wall surface 56 when in use. A pair of spring-like legs 34, 36 extend from one end of the body 32 in parallel spaced relationship. Each of the legs 34, 36 terminates outwardly in a foot 38, 40 for removable association within the hanger holder 22.

Each foot 38, 40 comprises an inclined insertion edge 48 of arrow-like configuration. The feet 38, 40 terminate at their respective sides nearest to the body 32 in a retaining edge or locking edge 50, which edges extend at right angles to the longitudinal axes of the legs 34, 36.

As best seen in FIG. 1, initially the hanger 30 is associated loosely within the hanger holder 22 by inserting the hanger upwardly within the hollow interior space 24 of the hanger holder. The interaction between the outer extremeties of the feet 38, 40 and the hanger holder sides 62, 64 urges the hanger legs 34, 36 together against the natural spring bias of the hanger material until the feet 38, 40 are urged interiorally of the hanger holder 22. Then by continuously pushing the hanger 30 upwardly within the holder 22, the feet 38, 40 will be pushed upwardly clear of the hanger holder top 26, whereat the natural memory of the plastic material forming the legs 34, 36 will function to return the legs to their normal, parallel position as illustrated in FIG. 3. After the legs 34, 36 resume their parallel position, as illustrated in FIG. 1, the hanger feet 38, 40 will extend beyond the sides 62, 64 of the holder 22 and the respective retaining edges 50 of the hanger feet 38, 40 will rest upon the top surface 26 of the hanger holder 22 when the broom 10 is inverted as illustrated for display and vending purposes.

Still referring to FIGS. 1, 2 and 3, the hanger 30 is molded or otherwise conventionally fabricated to form an integral hook 44, which hook is spaced from the body 32 by an integral spacer 46. The hook 44 and the spacer 46 are specifically designed and configured to receive and support the broom 11 by engaging the V-shaped notch 28 of the hanger holder 22. See FIG. 5.

In order to use the broom and broom hanging system 10 of the present invention, as best seen in FIGS. 3, 4 and 5, the hanger 30 must first be removed from association within the hanger holder 22 from the position illustrated in FIG. 1. This can be readily accomplished simply by squeezing the feet 38, 40 together until the outer extremities of the feet interiorly fit within the hollow space 24 defined between the hanger holder sides 62, 64 to thereby remove the hanger 30 from its releasable engagement within the hanger holder 22, as illustrated in phantom lines in FIG. 1. The hanger 30 is then inverted as in FIGS. 2 and 4 without inverting the broom 10.

With the head 42 facing upwardly in the position shown in FIG. 3, the peel strip 54 is then removed from the rear surface of the hanger 32 to expose the adhesive material 52. When the adhesive 52 is thus exposed, a suitable location on a vertical surface such as on the wall 56 is selected and the hanger 30 can be secured on the wall by simply pressing the adhesive surface 52 against the wall in known manner. It is noteworthy that the hook 44 faces in the direction of the head 42, whereby the head can serve as a ready indicator to the purchaser of the broom hanging system of the proper orientation of the hanger 30. Once the hanger 30 has been secured to the wall 56 by the adhesive 52 in the manner illustrated in FIGS. 4 and 5, the broom 11 can be easily hung in the preselected position simply by applying the V-shaped notch 28 of the hanger holder 22 over the hook 44 until the spacer 46 engages the notch 28 and the hook itself extends into the hollow interior space 24, which space is configured to provide sufficient clearance to facilitate easy hanging of the broom.

Although the invention has been described with a certain degree of particularity, it will be understood that the present disclosure has been made only by way of example and that numerous changes in the details of construction and the combination and arrangement of parts may be resorted to without departing from the spirit and scope of the invention.

What is claimed is:

1. A combination broom and broom hanging system of the type including a broom having a handle and sweeping portion affixed at one end of the handle comprising a shroud secured about the sweeping portion and adapted to move when the broom is moved, the shroud comprising a sidewall and a hanger holder integral with and extending from the shroud; and a hanger removably engaged with the hanger holder, the hanger comprising a body, leg means of predetermined thickness extending from the body to releasably engage the hanger holder, means to secure to a fixed surface and hook means formed in the body to hang the broom, the hanger being movable from a first, storage position in association with the hanger holder and a second, hanging position that is on the fixed surface;

whereby the broom may be supported upon the fixed surface by affixing the hanger to the surface by utilizing the means to secure and then engaging the hook means portion of the hanger with a portion of the hanger holder.

2. The combination broom of claim 1 wherein the hanger holder defines a hollow interior and wherein the leg means of the hanger is removably secured within the interior in juxtaposition to the broom shroud sidewall.

3. The combination of claim 2 wherein the hanger holder comprises an outer wall extending laterally between a pair of spaced hanger holder sidewalls, the outer wall being spaced away from the shroud sidewall by a distance greater than the thickness of the hanger leg means.

4. The combination of claim 3 wherein a V-shaped notch is formed in the outer wall of the hanger holder, the V-shaped notch being engageable upon the hook means of the hanger to support the broom upon the hanger when the hanger is secured to the fixed surface.

5. The combination of claim 3 wherein the leg means comprises a pair of spaced legs extending from the body, at least one leg terminating endwardly in a laterally extending foot.

6. The combination of claim 5 wherein the distance between the sidewalls of the hanger holder is greater than the width defined by the hanger legs, whereby the legs can be bent to removably insert within the hanger holder.

7. The combination of claim 6 wherein the overall width of the hanger legs measured at the laterally extending foot is greater than the spacing between the said hanger holder sidewalls.

8. The combination of claim 1 wherein the hanger further comprises a head extending from the body, the head extending in a direction opposite to the direction of extension of the leg means.

9. The combination of claim 8 and indicator means on the hanger to indicate the proper orientation of the hanger when secured upon the surface.

10. The combination of claim 9 wherein the indicator means is positioned on the head.

11. A broom with self contained broom hanging system comprising a broom including an attached, enclosing shroud about a portion thereof;

a hollow hanger holder integrally formed with and extending from the shroud, the hanger holder including support means to support the broom, the hanger holder defining an interior space; and a separable hanger removably stored within the hanger holder interior space, the hanger being movable relative to the hanger holder, the hanger comprising a body, an adhesive affixed to a portion of the body, a hook, and leg means for releasably engaging the hanger holder, whereby the hanger can be removed from the hanger holder, can then be affixed by its adhesive to a surface to then support the broom by engaging the hanger holder support means upon the hook.

12. The broom with self contained broom hanging system of claim 11 wherein the hanger holder interior space is defined between an outer wall, a pair of spaced side walls and a portion of the shroud and wherein the said support means is formed in the said outer wall, the support means comprising an inverted V-shaped notch.

13. The broom with self contained broom hanging system of claim 12 wherein the leg means comprises portions that are less in width than the spacing between the sidewalls and portions that are greater in width than the spacing between the sidewalls.

14. A broom with self contained broom hanging system comprising a broom including an enclosing shroud about a portion thereof;

a hanger holder secured upon the shroud, the hanger holder including support means to support the broom, the hanger holder defining an interior space, the hanger holder interior space being defined between between an outer wall, a pair of spaced side walls and a portion of the shroud, the space being generally rectangular in cross sectional configuration, the said support means being formed in the said outer wall, the support means comprising an inverted V-shaped notch, a separable hanger removably stored within the hanger holder interior space, the hanger comprising a body, an adhesive affixed to a portion of the body, a hook and leg means for releasably engaging the hanger holder, the leg means comprising portions that are less in width than the spacing between the sidewalls and portions that are greater in width than the spacing between the sidewalls, the leg means comprising a pair of spaced, parallel, spring-like legs extending from the body, the legs terminating outwardly in laterally extending feet, the feet being generally of arrow-like configuration; whereby the hanger can be removed from the hanger holder, can then be affixed by adhesive to a surface and can then support the broom by engaging the hanger holder support means upon the hook.

15. The method of hanging a broom of the type comprising a plurality of fibers, an elongate handle connected to the fibers, and a shroud including a sidewall always surrounding a portion of the fibers comprising the steps of affixing a hanger holder to the shroud sidewall and positioning the hanger to extend laterally outwardly from the sidewall;

removably securing a broom hanger within the hanger holder;

removing the broom hanger from the hanger holder;

affixing the broom hanger to a vertical surface; and moving the broom with the shroud and applying a part of the hanger holder to a part of the broom hanger to hang the broom upon the vertical surface.

16. The method of claim 15 wherein the affixing comprises integrally molding the hanger holder and the shroud.

17. The method of claim 16 wherein the removably securing includes squeezing portions of the broom hanger to reduce one dimension sufficiently to insert a part of the hanger into the hanger holder.

18. The method of claim 17 wherein the removing comprises squeezing portions of the broom hanger to reduce one dimension sufficiently to fit within the hanger holder.

* * * * *